US005814980A

United States Patent [19]

Lewis

[11] Patent Number: 5,814,980

[45] Date of Patent: Sep. 29, 1998

[54] WIDE RANGE VOLTAGE REGULATOR

[75] Inventor: Scott C. Lewis, Essex Junction, Vt.

[73] Assignee: International Business Machines Corporation, Armonk, N.Y.

[21] Appl. No.: 706,861

[22] Filed: Sep. 3, 1996

[51] Int. Cl.[6] ..... G05F 3/04

[52] U.S. Cl. ..... 323/311; 323/282

[58] Field of Search ..... 323/282, 285, 323/351, 311, 315, 286, 287; 307/86

[56] References Cited

U.S. PATENT DOCUMENTS

| | | | |
|---|---|---|---|
| 4,628,248 | 12/1986 | Birritella et al. | 323/314 |
| 4,731,574 | 3/1988 | Melbert | 323/275 |
| 4,743,833 | 5/1988 | Johnson | 323/224 |
| 4,755,767 | 7/1988 | Yamatake | 330/257 |
| 4,797,577 | 1/1989 | Hing | 307/297 |
| 4,950,916 | 8/1990 | Moran | 307/82 |
| 4,952,863 | 8/1990 | Sartwell et al. | 323/280 |
| 5,045,771 | 9/1991 | Kislovski | 323/282 |
| 5,124,632 | 6/1992 | Greaves | 323/316 |
| 5,130,635 | 7/1992 | Kase | 323/280 |
| 5,345,166 | 9/1994 | Leonard et al. | 323/324 |
| 5,392,205 | 2/1995 | Zavaleta | 363/59 |
| 5,461,301 | 10/1995 | Truong | 323/207 |
| 5,508,604 | 4/1996 | Keeth | 323/314 |
| 5,512,814 | 4/1996 | Allman | 323/267 |
| 5,594,323 | 1/1997 | Herfurth et al. | 323/222 |

*Primary Examiner*—Adolf Berhane
*Attorney, Agent, or Firm*—Schmeiser, Olsen & Watts; Robert A. Walsh

[57] ABSTRACT

A voltage regulating system and method are disclosed for use in an integrated circuit. The voltage regulating system can operate with a supply voltage ranging from 2.9 to 5.5 volts. The voltage regulating system includes a differential amplifier which is connected in series to a linear amplifier. The circuit contains level shifters so that the voltage regulator can operate with very low supply voltages.

19 Claims, 2 Drawing Sheets

WIDE RANGE VOLTAGE REGULATOR

BACKGROUND OF THE INVENTION

1. Technical Field

This invention relates to integrated semiconductor circuits and more particularly to voltage regulator systems.

2. Background Art

A voltage regulator is a circuit or device used to control the output of a load or to regulate the voltage of an electronic device despite fluctuations in the circuit conditions, particularly variations in the supply voltage. Voltage regulators can be used to maintain the voltage constant at given point in a circuit or to vary it in a controlled manner.

Voltage regulators are often used for high performance systems, such as high speed dynamic random access memory (DRAMs) semiconductor chips. An effective on-chip voltage regulator responds to a variation in circuit load requirements so that circuit operation and speed are not compromised. However, efficient voltage regulator design becomes increasingly difficult with greater variation in circuit load requirements.

In the 1980's, the semiconductor industry began offering components that operate for both 3.3 volt applications as well as for the older 5 volt standard. Besides the inventory disadvantages of having two types of voltage regulators that operate with 3.3 volt and 5 volt components, many components have to be scrapped after burn-in (a long and carefully controlled preliminary operation of a device to stabilize its electrical characteristics after manufacture) because they won't meet the 3.3 volt requirements and can no longer be downgraded to a 5 volt part.

The newest 16 megabyte process needs a voltage regulator drive output to act as an on-chip low voltage power supply terminal for dense, high-speed circuits designed for an internal 2.5 volt operation and formed on the same chip with other circuits designed for 3.3 volt and 5 volt operation. Currently, the designer has to design two different types of parts for the two different voltage applications. Another existing problem is that voltage regulators change performance drastically with the voltage supply changing between 2.9V and 5.5V. The same voltage regulator that would work for a 5 volt part stepping down to 3.3 volts would not respond quick enough when going down to a lower voltage. There is a requirement for a regulator with the same performance whether it is stepping down from 5 volts or 3.3 volts.

SUMMARY OF THE INVENTION

Disclosed is a system and method for regulating the voltage in a semiconductor chip. The system and method utilize a differential amplifier connected to a linear amplifier to regulate the supply voltage over a wide range. Level shifters may also be used so that the voltage regulator can operate at low supply voltages.

It is therefore an advantage of the present invention to not only allow operation over a wide range (2.9 to 5.5 volts), but to do so with less performance variation than presently available within just the 5 volt range (4.5 to 5.5 volts).

It is a further advantage of the present invention to use the same voltage regulator for both 3.3 and 5.0 volt supply voltage operation with no modification.

It is a further advantage of the present invention to operate efficiently both at very low current levels in standby periods and at much higher current levels when the chip is selected.

It is a further advantage of the present invention to provide an automatic start up feature and a bypass feature.

It is a further advantage of the present invention to provide a voltage regulating system with excellent performance results in terms of speed and low power consumption.

It is a further advantage of the present invention to provide a wide-range, reliable, compatible, and stable on-chip low voltage regulating system having improved performance.

DESCRIPTION OF THE PREFERRED EMBODIMENTS

Figure 1:
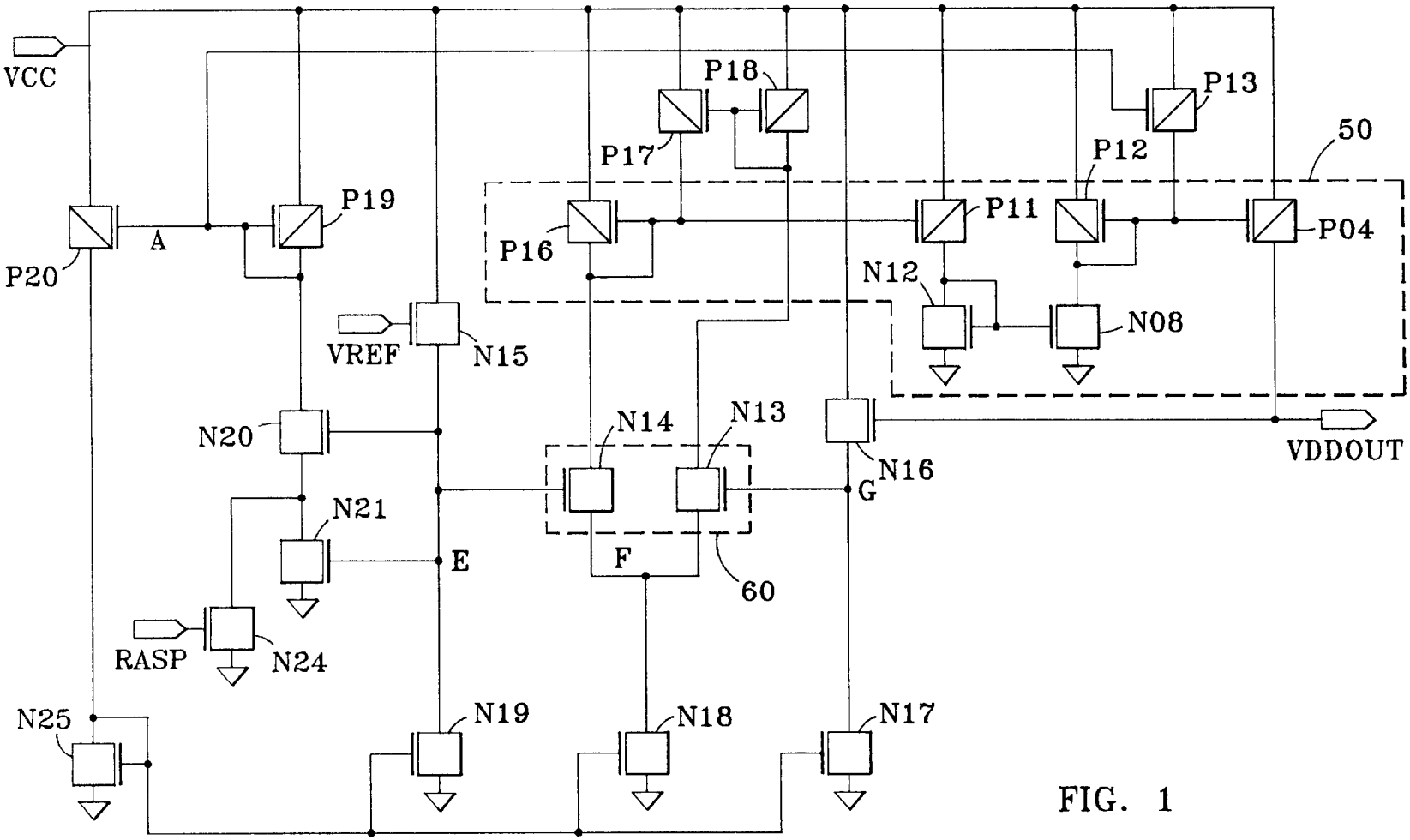
FIG. 1 depicts a circuit diagram of a preferred embodiment of the voltage regulator system of the present invention.
Figure 2:
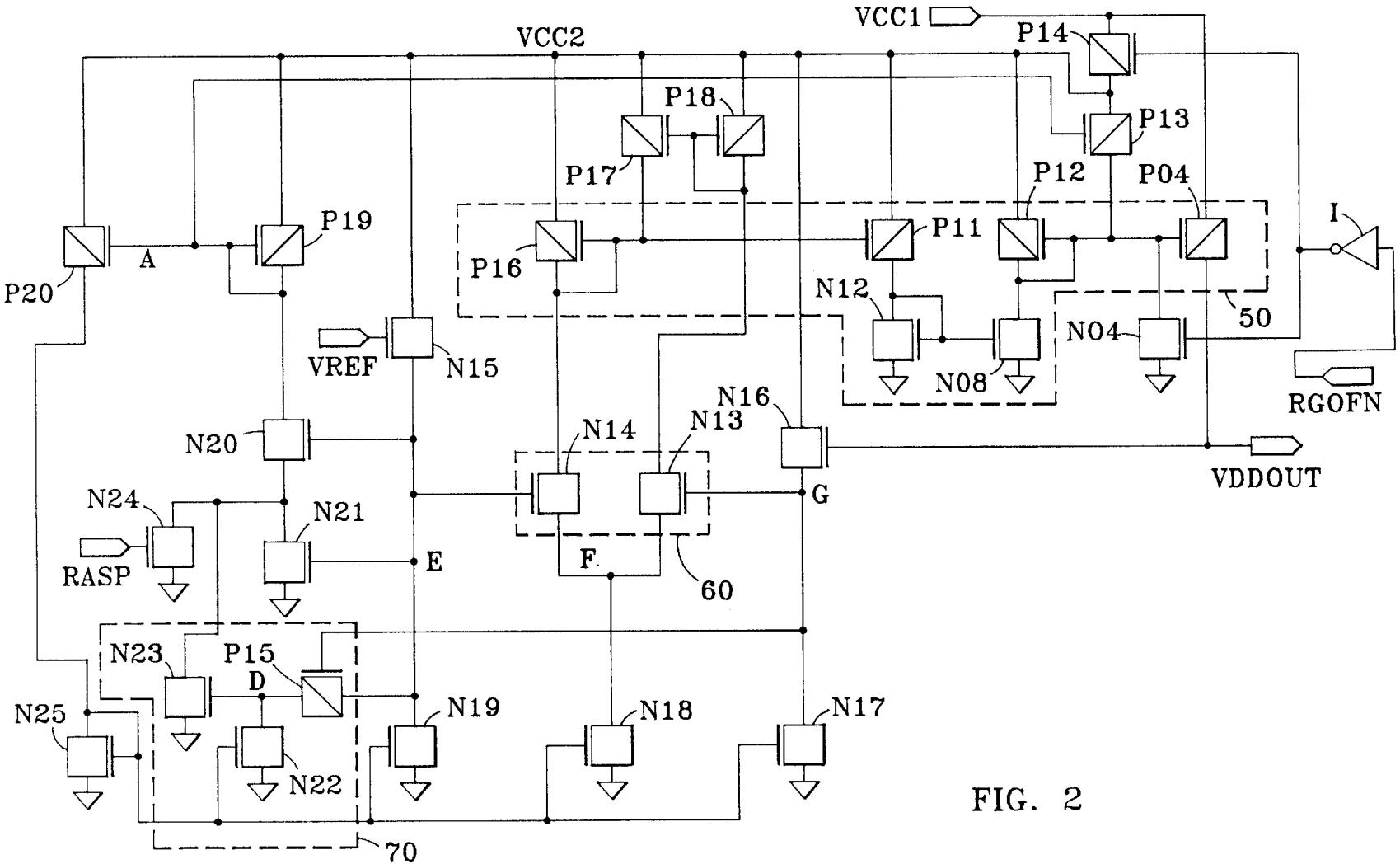
FIG. 2 depicts a circuit diagram of an alternate embodiment of the voltage regulator system.

In FIG. 1 and FIG. 2, the P-channel field effect transistors (PFETs) are indicated by a rectangle with a diagonal line formed within the rectangle and with a line adjacent and parallel to one side of the rectangle indicating the gate or control electrode of the transistor, and N-channel field effect transistors (NFETS) are indicated simply by a rectangle without the diagonal line and with a line adjacent to one side of the rectangle indicating the gate or control electrode of the transistor. While the sizes and electrical specifications of some of the transistors have been disclosed, it should be recognized that substitutes could be used to perform the same function. Also, while the invention is described for use with DRAMs, it may be used for other applications.

Referring to FIG. 1 of the drawings in more detail, there is depicted an embodiment of the wide-range voltage regulator system of the present invention, preferably made in an integrated semiconductor substrate in complementary metal oxide semiconductor (CMOS) technology. This voltage regulator system has a two level power feature. This new voltage regulator operates efficiently and uses minimum power both at very low current levels in standby periods (the state in which the chip equipment is out of operation but may be immediately activated) and at much higher current levels (approximately 10–12 times the lower current levels) when the chip is selected (the state when the equipment is activated). Specifically, in the higher power state the current source may go up to about 70 $\mu$A which allows faster response and a maximum output of approximately 300 mA.

FIG. 1 shows a transistor P20 which has its drain electrode serially connected with transistor N25 and its source electrode connected with the positive voltage power supply terminal VCC. The gate or control electrode of transistor P20 is connected to the common point or node A between the transistors P20 and P19. Transistor P19 has its source electrode connected to VCC and its gate and drain connected to form a diode. P20 and P19 are connected in a current mirror arrangement. Therefore, the current that runs through P19 will be approximately equal to the current that runs through P20.

Transistor N25 is connected in series with the transistor P20. Transistor N25 has the gate and drain electrodes connected together to form a diode and the source electrode of the transistor is connected to a point of fixed potential, preferably ground.

The control electrode of transistor N24 is connected to the RASP (Row Address Select Positive) input to the DRAM chip. RASP goes positive whenever the chip is selected and the circuit is to be operated in the high power mode. The source electrode of transistor N24 is connected to ground and the drain is connected to a common point located between transistors N20 and N21.

The combination of transistors N15 and N16 with bleeders N19 and N17 are used as level shifters for the inputs to a differential amplifier 60. (Bleeders are defined as devices which pull only a small current). Transistor N15 is connected to a reference voltage terminal VREF (which is a constant dc voltage source). VREF is used as a comparison for the whole circuit. The drain electrode of transistor N15 is connected to the power supply terminal VCC and the source electrode is connected in series with N19. N19 may be 2.0 microns wide and 1.0 micron long. The control or gate electrode of transistor N16 is connected to the voltage regulator output terminal, VDDOUT. VDDOUT acts as an on-chip low voltage power supply terminal for dense, high speed circuits. The source of transistor N16 is connected to VCC and the drain is connected to node G. N16 may be 5 microns wide and 1.0 microns long and N17 may be 2.0 microns wide and 1.0 microns long. The level shifters allow the voltage regulator to work with very low values of VCC. If VCC is always expected to be at least a full threshold voltage (Vt) (the minimum value of voltage at which a certain effect takes place) higher than VDDOUT then the level shifters are not needed. Also, note that transistor N18 may have a width of 24.0 microns and a length of 1.0 micron.

Transistors N20 and N21 are high impedance NFETs that establish a low level current reference (for example, approximately 0.5 $\mu$A) with a gate overdrive of VREF−2* (Vt) where Vt is the threshold voltage which is sufficient to turn on the control transistor, P13, so as to maintain the voltage at the output terminal VDDOUT at a set voltage during standby. Transistors N20 and N24 are turned on by the RASP. The transistor N21 may be a large device with a width of 1.0 micron and a length of 39 microns. The transistor N20 may have a width of 1.0 micron and a length of 3.0 microns.

The voltage regulator has a differential amplifier 60 formed of a pair of transistors N14 and N13. The differential amplifier senses any differences occurring in voltage between that of VREF and the voltage which is occurring at the regulator output terminal (VDDOUT). The differential amplifier 60 requires three current sources (N18, N17, and N19) to operate. Normally, only one current source is needed. However, since this is a level shifter differential amplifier it needs bleeder current sources for the level shifters, N15 and N16. There is a difficulty in finding devices that have high enough impedance to produce low enough current for the current level required. Differential amplifier transistor N14 may have a width of 6.0 microns and a length of 0.8 microns and transistor N13 can have a width of 6.0 microns and a length of 0.8 microns.

The linear multiplier 50 for the differential amplifier 60 consists of three current mirror stages. The first current mirror stage includes transistors P16 and P11, the second current mirror stage includes transistors N12 and N08, and the third current mirror stage includes transistors P12 and P04. In the present design, this circuit utilizes a large multiplier of 8,000 so that a 6 $\mu$A current source can control up to 48 milliamps of output current. To accomplish this result, the first stage P16 may be chosen to have a width of 3 microns and a length of 0.8 microns and P11 may have a width of 8 microns and a length of 0.8 microns. Therefore, the first stage will have a multiplying ratio of 8:3. The second stage transistor N12 may have a width of 2.0 microns and a length of 1.0 microns and transistor N08 may have a width of 30 microns and a length of 1.0 micron. The second stage will have a multiplying ratio of 15:1. In the third stage, transistor P12 may have a width of 60 microns and a length of 0.8 microns and transistor P04 can have a width of 12,000 microns and a length of 0.8 microns. The third stage will have a multiplying ratio of 200:1. The output transistor P04 is a low impedance device. The number of current mirrors is not fixed and may range from at least one to a plurality of current mirrors depending on the desired output.

Transistors P17 and P18 form another current mirror that prevent the saturation of the differential amplifier 60 during standby. Transistor P17 may be 3 microns wide and 0.8 microns long and transistor P18 may be 3.0 microns wide and 0.8 microns long.

Control transistor P13 has its gate connected to point A between P20 and P19, its source connected to VCC, and its drain connected to a point between transistor P12 and output transistor P04.

The operation of the circuit shown in FIG. 1 is explained as follows. In the standby mode, when the RASP is turned off, VREF establishes a low bias at node E which is one threshold lower than VREF. That voltage is enough to ensure that N20 and N21 are turned on with a predictable amount of drive. Therefore, there is an established current going through N21 and N20 which is relatively low (e.g., 0.5 $\mu$A). To accomplish this, a long channel device is required here (e.g., a transistor N21 with a length of 39 microns). The current is then put through the current mirror, P19 and P20, so that approximately the same amount of current being pulled through P19 is being pulled through P20. The current through P20 is then forced through N25 which is connected to form a diode (gate and drain are connected together). Therefore, the current in N21 is the same current that goes through N25 since the current went through a 1:1 current mirror with the PFETS, P19 and P20.

Transistor N25 also forms a current mirror with the current sources N19, N18, and N17. Transistors N19 and N17 have the same current gain and the current gain in N18 is 12 times larger than the gain of N19 and N17. The current in N18 may be, for example, 6 $\mu$A at this point. The lengths of the three transistors may all be 1 micron, the width of N19 and N17 may be 2.0 microns, and the width of N18 may be 24.0 microns. Therefore, the value of the current sources during standby is established.

In select mode or high power mode the circuit behaves as follows. The three current sources increase. When the circuit goes from standby to select, and the RASP is turned on, transistor N21 is bypassed and only transistor N20 establishes the current, which is at a much higher current level. Therefore, during select, approximately 10–12 times the current level of standby is going up to P19 which then gets reflected down through P20 to N25 and then through the current sources N19, N18, and N17. Therefore, when the RASP is turned on the three current sources go to a current level that is one order of magnitude higher current level. The result is that both the current level in the differential amplifier 60 and the output current capability rise by a factor of 10–12.

Transistors N15 and N16 with bleeders N19 and N17 are used as level shifters for the inputs to transistors N14 and N13. The level shifters are used so that the voltage regulator can work with very low values of VCC. If VCC is always expected to be at least a Vt higher than VDDOUT these are not needed. Transistors N15 and N16 are relatively large devices with a relatively small current going through them. Transistors N19 and N17 are relatively high impedance devices with low gate drives so that they do not draw much current (approximately 2 μA each). Transistor N16 is barely on because only very small currents are going through it and it is a large device. The voltage level at G mirrors VDDOUT except that it is 0.7 or 0.8 volts lower and ends up being one threshold voltage down from VDDOUT. The same is true of the voltage level at E which mirrors VREF and is down the same drop of 0.7 or 0.8 volts. The voltage level varies a small amount with the processing but transistors N15 and N16 will track with each other so that the voltage drop will be the same for both of them. Therefore, any differential between VREF and VDDOUT will have the same differential between nodes E and G.

Usually, a differential amplifier needs one current source but the 3 current sources are used in this voltage regulator since a level shifter differential amplifier is being used. In this circuit there is needed bleeder current sources (N19 and N17) for the level shifters. The level shifters use current mirrors because of the difficulty in obtaining devices that have the high impedance to achieve the low current levels required.

The differential amplifier 60 operates by comparing the gate voltages of transistors N14 and N13. The differential amplifier 60 goes up or down with respect to the voltage level at node E which causes VDDOUT to go up or down with respect to VREF. The voltages at inputs E and G are a reflection of what is happening between VREF and VDDOUT. The current source N18 shifts from N14 to N13 as the voltage at G goes up and the current source N18 shifts from N13 to N14 as the voltage at G goes down. Therefore, a shift occurs in the currents between N14 and N13 based on the voltage differences. The resulting differential amplifier output current is fed into the linear multiplier 50 at transistor P16.

The output of the differential amplifier 60 is multiplied by a very large, but still linear amount. The linear multiplier can range from 100 up to 100,000. In the present example this factor is 8000. (A factor of 20,000 could also be chosen and P11 would be widened to 20 microns to accomplish this). As the chosen value of the linear multiplier increases, the voltage regulating circuit becomes more sensitive so that a smaller drop in output voltage of the differential amplifier will allow the circuit to get to obtain a value of 300 milliamps quicker.

The linear multiplier 50 is made up of three current mirror stages. In the first current mirror stage, P16 and P11 have the same channel length and P11 is wider than P16 to achieve a multiplying factor of 8 to 3. In the second current mirror stage, transistors N8 and N12 have the same channel length and N08 is wider than N12 to achieve a multiplying factor of 30 to 2. In the third stage, P12 and P04 both have same channel length and achieve a multiplying factor of 12,000 to 60 which is approximately a factor of 200. The circuit could be designed to have less than three current mirror stages and have only one or two stages, but it would be less efficient.

Transistor P18 operates as a load for transistor N13. While the circuit would basically still work without transistors P18 and P17 in it, P18 and P17 prevent the circuit from saturating in the standby state. For instance, if the voltage level at G was higher than that at E by a significant amount (for example 100 millivolts) N13 would be carrying all the current along with P18. P18 would turn on P17 an equal amount because P17 and P18 are coupled together as a current mirror (i.e., if P18 is on, P17 carries approximately the same amount of current). As G goes down in voltage and approaches E, the current in N14 will increase and N13 will decrease. As the current in N13 decreases, the current in P18 decreases the same amount and the current driving P17 also decreases. Eventually a balancing point is reached where E and G are exactly the same voltage and half the current is in each of transistors N13 and N14. Therefore, transistors P18 and P17 have exactly the same current, and P16 has yet to turn on. At this point, P18 and P17 are carrying all the current required by the current source, N18. If G goes down another millivolt, the current begins to pass through P16, and P16 turns on and amplification starts. The result is that transistors P18 and P17 provide a way to bias the differential amplifier 60 and keep it balanced until an output is required.

By using "diode" load devices (P16 and P18), the differential amplifier 60 can operate in extreme ranges. Transistor P17 allows a quicker recovery of the gate of P11 during decreasing demand. P13 provides a complete turn off, eliminating the tendency for the output to "creep up" in subthreshold operation.

The output of the circuit in FIG. 1 is connected to a decoupling capacitor (not shown) on a chip which is driven by the voltage regulator.

The new voltage regulator operates efficiently both at very low current levels in standby and at much higher levels (10–12 times the low current levels) during select. Specifically, in the higher power state the current source is brought up to about 70 μA allowing faster response and a maximum output of approximately 300 μA.

This voltage regulator will operate with both 3.3 and 5 volt applications over a wide range of 2.9 to 5.5 volts without modification and will have excellent performance results in terms of speed and low power consumption.

Referring to FIG. 2, there is a depicted an alternative embodiment of the voltage regulator system. This a more complete version of the voltage regulator system which includes automatic full power start up and bypass methodology. (The actual circuit also includes reference input filtering and turn off delay which are not shown). Automatic full power start up is important because in present day requirements the time elapsed between the demand for high power from the output terminal VDDOUT and the time at which a basic voltage regulator circuit can supply the required high power is too long. Today's integrated semiconductor circuits cannot tolerate such long delays. Thus, in accordance with the teachings of this invention, an automatic full power start up feature has been added. A bypass feature is necessary during manufacturing for test modes, characterization, burn in, and other reasons.

FIG. 2 includes the circuit of FIG. 1 with the addition of devices N22, N23, P15, P14, N04, and an inverter I connected to RGOFN (Regulator Off Negative). Also, the supply voltage is VCC1 and VCC2 is the voltage supply after the current from VCC1 has passed through transistor P14.

The automatic full power start up circuit 70 includes the transistors N22, N23, and P15. Transistor N22 has its source connected to ground, its gate electrode connected to the current sources N19, N18, and N17, and its drain connected to node D located between transistor N23 and P15. Transistor N23 has its source connected to ground, its gate connected to point D, and its drain connected to a point B. P15 has its source connected to point D, its drain connected to a point between transistors N19 and N15, and its gate connected to a point between transistors N16 and N17. The bypass feature includes transistors P14 and N04 and the inverter I which is connected to RGOFN. P14 has its source connected to VCC1 and its gate electrode connected to the gate electrode of N04. The drain of P14 forms VCC2. N04 has its source connected to ground and its drain connected to a point between P12 and P04.

The operation of the circuit shown in FIG. 2 is explained as follows. The automatic full power start up circuit 70 requires the addition of transistors N22, N23, and P15 which cause the voltage regulator to switch to high power mode whenever the output is more than a full Vt (threshold voltage) lower than the reference voltage VREF. This condition, encountered during power up, will cause P15 to turn on N23 and will shunt out N21 enabling the higher power mode. As soon as VDDOUT is sufficiently high the operation falls back into the low power mode.

Bypass is achieved by allowing a negative input at RGOFN to cause P14 to turn off, disabling all the control circuitry, while N04 turns on the output device P04. In this way VCC1 is steered directly into the other components on the chip.

Although certain preferred embodiments of the present invention have been shown and described in detail, it should be understood that various changes and modifications may be made without departing from the scope of the appended claims. The scope of the present invention will in no way be limited to sizes of constituting components, the materials thereof, the shapes thereof, the relative arrangement thereof, etc., and are disclosed simply as an example of the embodiment.

What is claimed is:

1. A voltage regulator system having a reference input and a system output comprising:

a differential amplifier having a first input, a second input, and an amplifier output, the first input coupled to the reference input and the second input coupled to the system output, and wherein the amplifier output provides an output current proportional to the voltage difference between the reference input voltage and the system output voltage; and a linear multiplier having an input and an output, the linear multiplier input coupled to the amplifier output and the linear multiplier output coupled to the system output, said linear multiplier output providing a system output current to said system output, said system output current driving said system output to have a voltage substantially equal to said reference input.

2. The voltage regulator system of claim 1, and further comprising first and second level shifters, said first level shifter receiving said reference input and outputting a shifted reference input coupled to said first differential amplifier input, said second level shifter receiving said system output and outputting a shifted system output to said second differential amplifier input.

3. The voltage regulator system of claim 1, wherein the linear multiplier multiplies the amplifier output current by a factor of approximately 8000.

4. The voltage regulator system of claim 1, wherein the linear multiplier multiplies the amplifier output current by a factor of approximately 20,000.

5. The voltage regulator system of claim 1, wherein the linear multiplier includes at least one current mirror stage.

6. The voltage regulator system of claim 1, wherein the linear multiplier comprises 3 current mirror stages.

7. The voltage regulator system of claim 1, wherein said differential amplifier drains a standby mode current is substantially less than a select mode current.

8. The voltage regulator system of claim 7, wherein the select mode current is approximately 12 times the standby mode current.

9. The voltage regulator system of claim 1, wherein the voltage regulator system is operable with the system input ranging from 2.9 to 5.5 volts.

10. The voltage regulator system of claim 1, wherein the differential amplifier is biased by a diode device.

11. The voltage regulator system of claim 1, and further comprising a bypass ciruit.

12. The voltage regulator system of claim 1, and further comprising an automatic full power startup circuit.

13. A semiconductor chip which includes a voltage regulating system with a voltage system input and a voltage system output, said voltage regulating system comprising:

circuit means for receiving the voltage system input ranging from 2.9 to 5.5 volts and providing a constant voltage system output, wherein said circuit means includes:

differential amplifier means for receiving a voltage reference signal and a voltage system output signal and generating a difference output current; and linear multiplier means for receiving said difference output current and producing the system output current, said system output current driving said voltage system output signal to be substantially equal to said voltage reference signal.

14. The semiconductor chip of claim 13, wherein said circuit means further comprises: first level shifting means for controlling a voltage level of the voltage reference signal and second level shifting means for controlling a voltage level of the voltage system output signal.

15. The semiconductor chip of claim 13, wherein the constant voltage system output is approximately 2.5 volts.

16. The semiconductor chip of claim 13, wherein the linear multiplier means multiplies the output of the differential amplifier by a factor of approximately 8000.

17. The semiconductor chip of claim 13, wherein the linear multiplier means multiplies the differential amplifier output by a factor of approximately 20,000.

18. The semiconductor chip of claim 13, wherein the linear multiplier means comprises at least one current mirror stage.

19. The semconductor chip of claim 13, wherein the linear multiplier means comprises 3 current mirror stages.

* * * * *

UNITED STATES PATENT AND TRADEMARK OFFICE

CERTIFICATE OF CORRECTION

PATENT NO.: 5,814,980
DATED : September 29, 1998
INVENTOR(S): Lewis et al.

It is certified that error appears in the above-identified patent and that said Letters Patent is hereby corrected as shown below:

Column 2, line 47 the text "response and a maximum output of approximately 330 mA" should read --response and a maximum output of approximately 300 $\mu$A.--

Column 3, line 34 the text "during standby. Transistors N20 and N24 are turned on by" should read --during standby. Transistors N20 and N21 are turned on by--

Column 7, line 16 the text "circuitry, while N04 turns on the output device P04. In this" should read --circuitry, while N09 turns on the output device P04. In this--

Column 7, line 50 the text "input. said second level shifter receiving said system output" should read --input, said second level shifter received said system output--

Signed and Sealed this

Sixteenth Day of March, 1999

*Attest:*

*Attesting Officer*

Q. TODD DICKINSON

*Acting Commissioner of Patents and Trademarks*